US005673572A

United States Patent [19]

Teng

[11] Patent Number: 5,673,572

[45] Date of Patent: Oct. 7, 1997

[54] DYEING MACHINE WITH REVERSIBLE DYE SPOUTER

[76] Inventor: Chi Lin Teng, 2nd Fl., No. 1, Aly. 40, LN. 292, Baoping Rd., Yongho City, Taipei County, Taiwan

[21] Appl. No.: 763,727

[22] Filed: Dec. 11, 1996

Related U.S. Application Data

[62] Division of Ser. No. 521,268, Aug. 30, 1995.

[51] Int. Cl.[6] ..... D06B 3/28

[52] U.S. Cl. ..... 68/205 R

[58] Field of Search ..... 68/62, 175, 176, 68/177, 178, 180, 181 R, 200, 205 R; 134/122 R

[56] References Cited

U.S. PATENT DOCUMENTS

| | | | |
|---|---|---|---|
| 3,837,187 | 9/1974 | Trullás | 68/177 X |
| 4,392,365 | 7/1983 | Miyamoto et al. | 68/177 X |
| 5,425,254 | 6/1995 | Fang-Ping | 68/177 X |
| 5,520,027 | 5/1996 | McCartney et al. | 68/62 X |

FOREIGN PATENT DOCUMENTS

| | | | |
|---|---|---|---|
| 2667332 | 3/1992 | France | 68/177 |
| 113065 | 5/1991 | Japan | 68/177 |
| 1547367 | 6/1979 | United Kingdom | 68/177 |

*Primary Examiner*—Philip R. Coe
*Attorney, Agent, or Firm*—Dvorak & Orum

[57] ABSTRACT

Disclosed is a fabric dyeing machine provided with a reversible dye spouter capable of selectively spouting the dye either in the forward direction or in the backward direction. The dyeing machine comprises a casing divided into a top fabric holder and a bottom fabric holder and the fabric holders can be subdivided into a number of subcontainers such that the quantity of fabric being processed at the same time can be increased. The reversible dye spouter comprises a forward nozzle for discharging dye in forward direction to dye the fabric and also force the fabric to move forwards; a reverse nozzle for discharging dye in reverse direction to dye the fabric and also force the fabric to move backwards. In normal operating conditions, the spouter is selected to be operated in forward mode so as to move the fabric forward from the entrance to the exit of the dyeing machine, and in abnormal operating condition when the self-folding of the fabric is disturbed such that the fabric is disorderly self-folded, the spouter can be switched to reverse mode so as to move the fabric backward and thus unfolding the disorderly folded fabric. After the fabric is unfolded, the spouter can be switched back to forward mode again so as to move the fabric forward again to try for another round to self fold itself neatly.

4 Claims, 16 Drawing Sheets

DYEING MACHINE WITH REVERSIBLE DYE SPOUTER

This is a divisional of copending application Ser. No. 08/521,268 filed on Aug. 30, 1995.

BACKGROUND OF THE INVENTION

1. Field of the Invention

The present invention relates to dyeing machines, and more particularly to a fabric dyeing machine provided with a reversible dye spouter capable of selectively spouting the dye either in the forward direction or in the backward direction.

2. Description of Prior Art

FIG. 1 shows a prior art fabric dyeing machine, which is composed of a cylindrical vessel A, a motor roller B, a fabric guide C, a pair of dye spouter D, a pump E, pipes F1, F2, F3, and heat exchanger G, and which is used to dye a strip of fabric S. The dye for coloring the fabric S is contained in the vessel A and, when used to dye the fabric S, is drawn by the pump E through the pipe F1, then sent to the heat exchanger G through the pipe F2 to be heated there, and finally directed to the spouter D through the pipe F3. At the spouter D, the dye is discharged at high speed onto the fabric S. Besides dyeing the fabric S, the high-speed discharging of the dye impels the fabric S to move forward to the right. At the right end of the vessel A, the fabric S is immersed in the dye and pulled by the roller B back to the spouter D so as to repeat the dyeing process cyclically.

The aforementioned dyeing machine has several drawbacks. First, the vessel A can contain only one single strip of fabric so that the quantity of fabric that can be processed at one time is limited. Second, when the fabric S is immersed into the vessel A, it is usually twisted due to high pressure of the large volume of dye in the vessel A, which somewhat hinders the-move of the fabric S in the vessel A. Third, the filtering screen on separators (not shown) provided in the vessel A is poor in filtering ability and, when the fabric and the dye are passing through the separator, could impede the move of the dye in such a way as to cause the fabric to be disturbed and thereby twisted. Fourth, the spouter D is single-head type which provides low dye discharging speed not sufficient to pull the fabric S at higher speed and therefore the motor roller B is required to pull the fabric S into the spouter D so as to accelerate the dyeing cycle. However, the motor roller S should move the fabric S by a pulling force substantially matching that exerted by the spouting dye, or the motor roller may wind the fabric S around itself and thus causing an abnormal operating condition to the dyeing machine. Fifth, if the duration of a strip of fabric undergoing the dyeing process exceeds a preset duration (usually 2.5 min.), the coloring on the fabric can be uneven, thus deteriorating the aesthetic appearance. However, using a single-head type of spouter the duration cannot be further shortened so as to accelerate the process, and it is a drawback of using multiple-head spouter that the increased quantity of the dye being spouted on the fabric can cause the fabric to be disorderly messed tip in the fabric guide C, thus causing the dyeing machine to stop operation.

In the prior art dyeing machine or FIG. 1 the dye spouter D is constructed with a structure shown in FIG. 2, which is composed of a casing 4', an entrance 40' and an exit 41' on the casing 4', separators 42', 43', and dye containers 44', 45'. A passage 46' is formed between the dye containers 44', 45' for the fabric to pass through the entrance 40' and the exit 41' so as to undergo the dyeing process. Slit-shaped nozzles 47', 48' are Formed on the separators 42', 43' to be used to spray the dye on the fabric. Note particularly that the nozzles 47', 48' are shaped in such a way as to discharge the dye at a 45 degree of angle toward the right (the direction of movement of the fabric through the dyeing machine as indicated by the big arrow in FIG. 2). This provision allows the high-speed stream of discharged dye to exert a pushing force on the fabric so as to push the fabric toward the right. After undergoing the dyeing process, the fabric is gathered in a fabric tank. There are circumstances that the fabric might be messed up due to excessive or overly forceful spraying of the dye. When this happens, the operator needs to stop the dyeing machine, wait until the temperature of the dyeing machine is lowered, and then use hands to arrange the fabric back to order, which is a laborious and time-consuming work to do. There therefore exists a need For a dyeing machine with a reversible spouter that can spray the dye in the reverse direction so as to pull back the fabric into order when the aforementioned circumstance happens.

SUMMARY OF THE INVENTION

It is therefore a primary objective of the present invention to provide a dyeing machine which can prevent the fabric undergoing the dyeing process from being messed up during the course of the dyeing process.

It is another objective of the present invention to provide a dyeing machine which allows the dyeing process to be more quickly completed It is still another objective of the present invention to provide a dyeing machine which is provided with a dye spouter capable of reversing the direction of spray the dye when the fabric is messed up so as to arrange the fabric back to order.

In accordance with the foregoing and other objectives of the present invention, there is provided with a novel dyeing machine with a reversible dye spouter.

The dyeing machine comprises a casing divided into a top fabric holder and a bottom fabric holder for supporting the fabric, during dyeing process, a plurality of spouters, provided on the top fabric container and the bottom fabric container holder, for spouting dye onto the fabric; a first screen, provided on the top fabric holder, for guiding the fabric to move through the top fabric holder and allowing excessive dye to drip therethrough so as to separate excessive dye from the fabric; a second screen, provided on the bottom fabric holder, for guiding the fabric to move through the bottom fabric holder and allowing excessive dye to drip therethrough so as to separate excessive dye from the fabric a first dye container, provided in the top fabric holder beneath the first screen, for containing excessive dye dripped through the first screen, a second dye container, provided in the bottom fabric holder beneath the second screen, for containing excessive dye dripped through the second screen; and a dye cycling device for sucking dye contained in the first dye container and the second dye container to the plurality of spouters, thereby allowing the spouters to spout dye on the fabric.

The reversible dye spouter comprises a dye supplying mechanism provided on the dyeing machine; a dye container for containing dye supplied by the dye supplying mechanism; a forward nozzle for discharging dye supplied by the dye supplying mechanism in forward direction to dye the fabric and also force the fabric to move forwards; a reverse nozzle for discharging dye supplied by the dye supplying mechanism in reverse direction to dye the fabric and also three the fabric to move backwards; a nozzle selector rotatably provided in the dye container, for selectively allowing discharging of dye through the forward nozzle and the reverse nozzle; and a driving mechanism for driving the nozzle selector.

BRIEF DESCRIPTION OF DRAWINGS

The present invention can be more fully understood by reading the subsequent detailed description of the preferred embodiments thereof with references made to the accompanying drawings, wherein.

DETAILED DESCRIPTION OF PREFERRED EMBODIMENT

Figure 1:
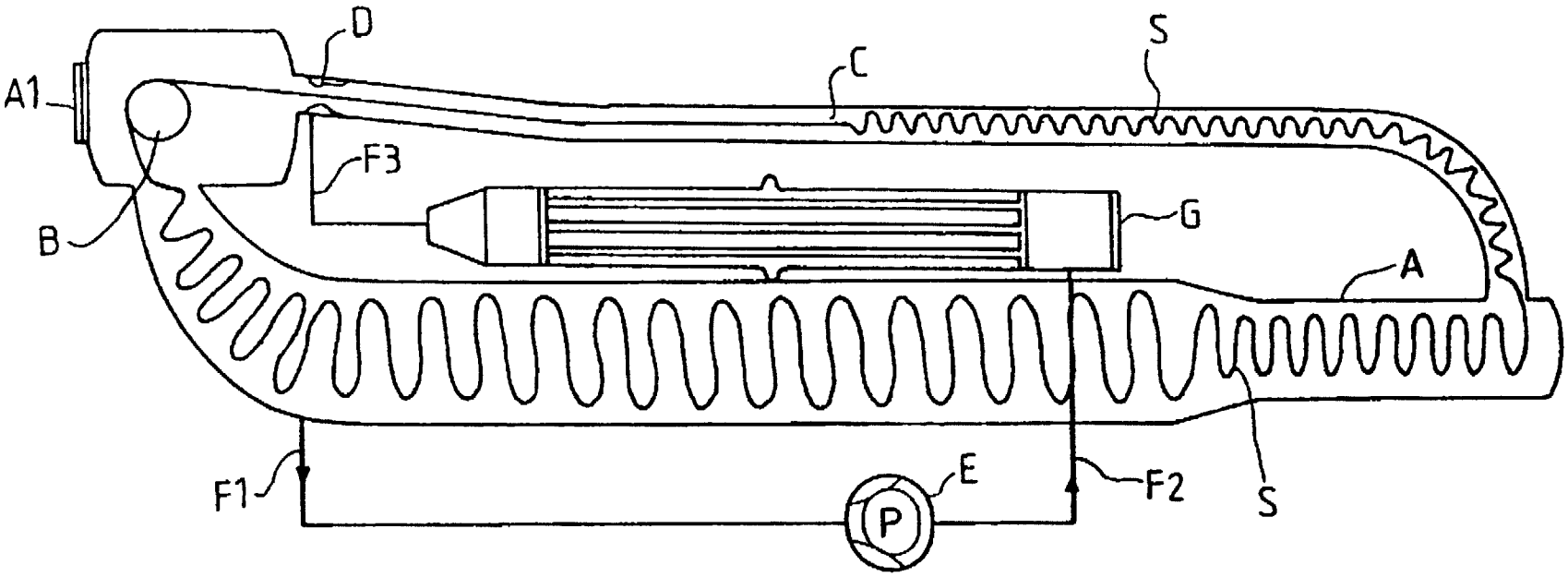
FIG. 1 (PRIOR ART)
FIG. 1 shows a schematic side view of a prior art dyeing machine.
Figure 2:
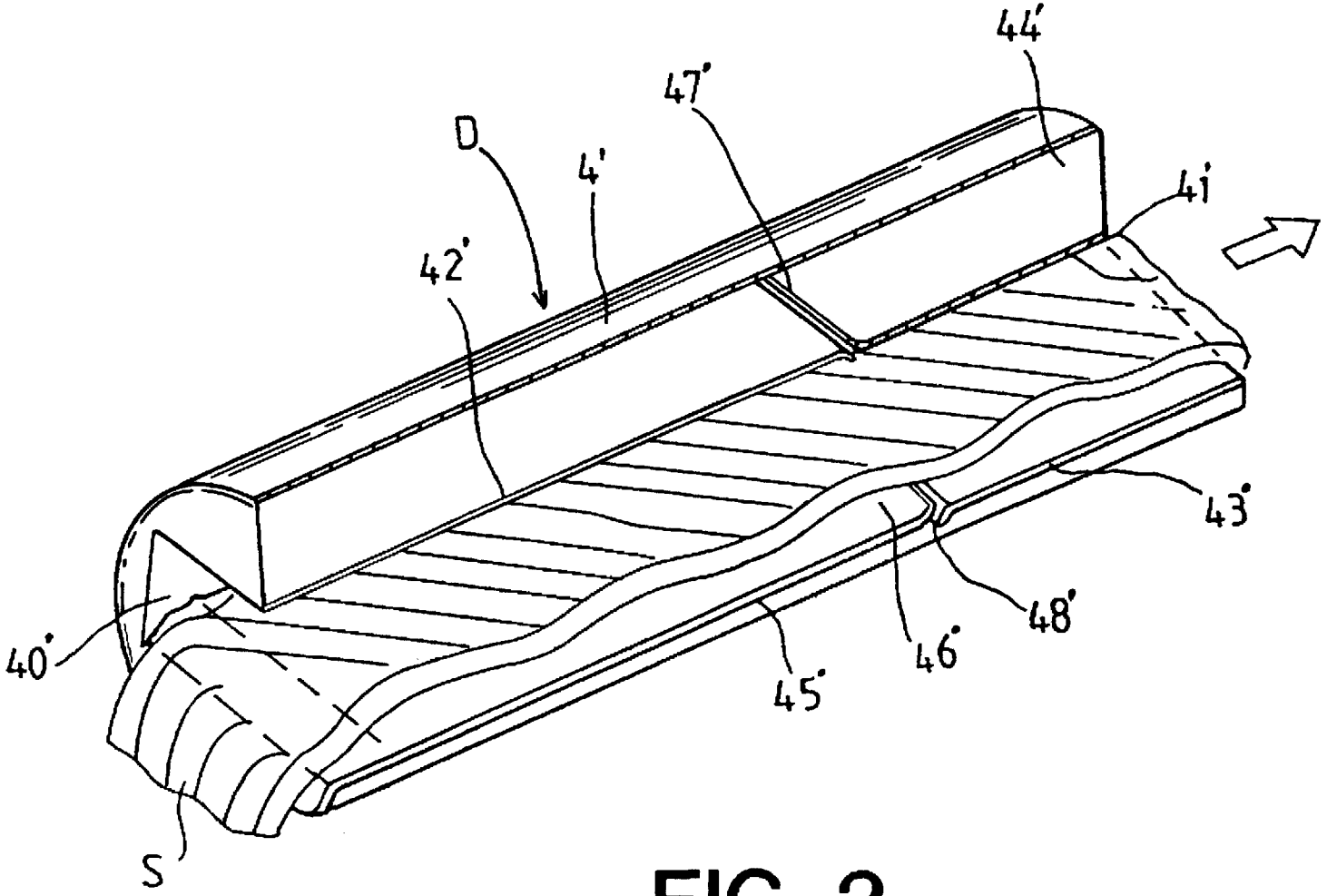
FIG. 2 (PRIOR ART)
FIG. 2 shows a perspective cutaway view of a prior art dye spouter employed in the dyeing machine of FIG. 1.
Figure 3:
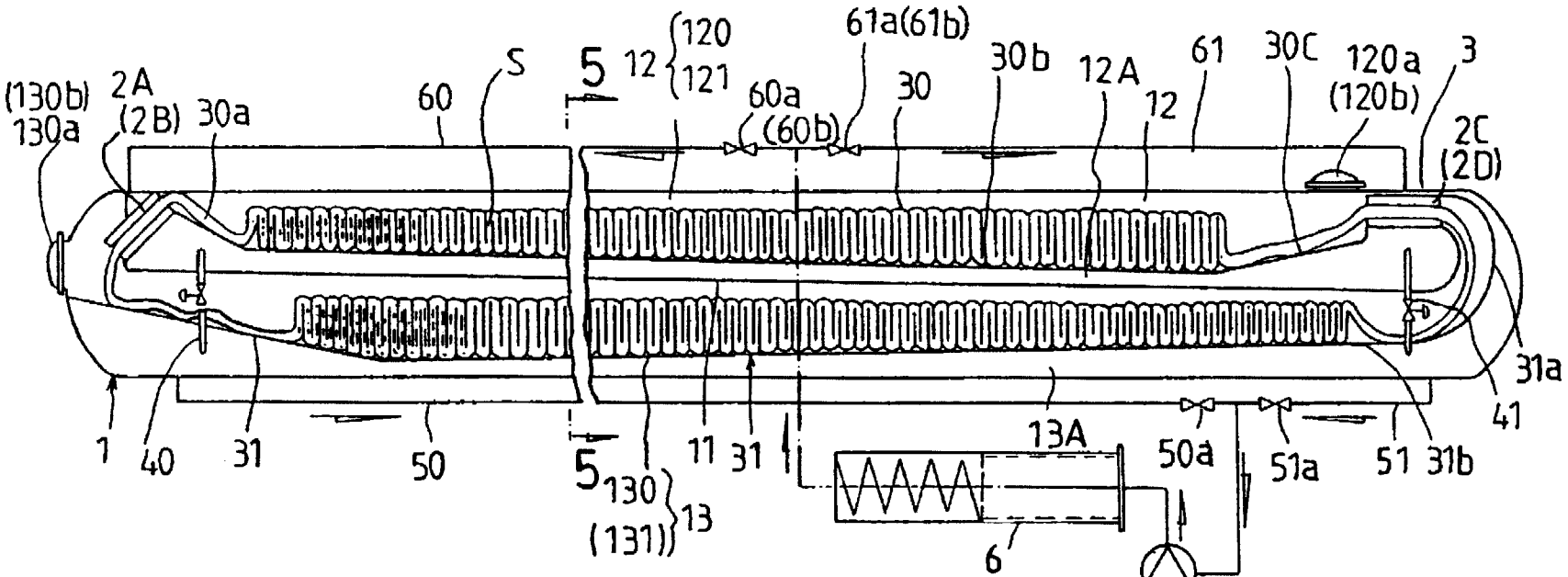
FIG. 3 shows a side cross-sectional view of a dyeing machine according to the present invention.
Figure 4:
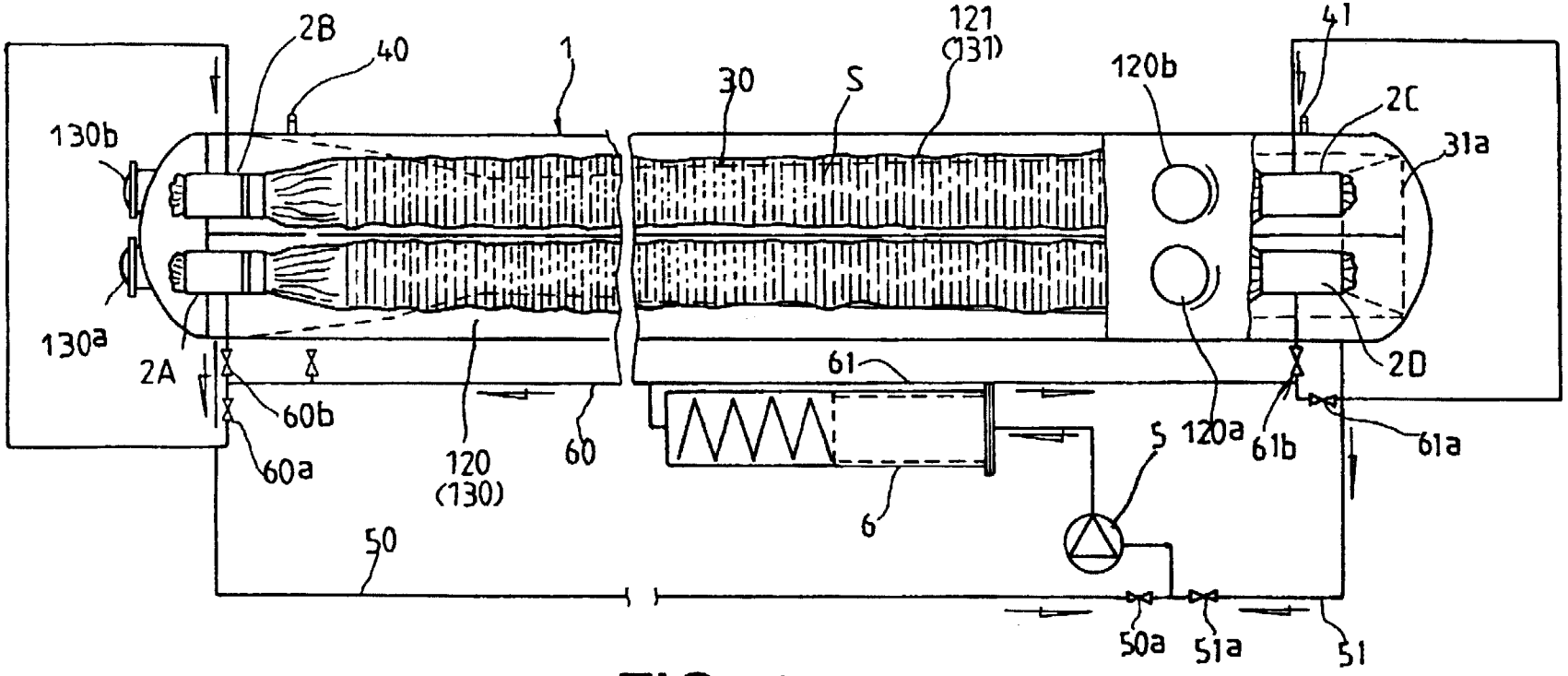
FIG. 4 shows a top cross-sectional view of the dyeing machine of FIG. 3.
Figure 5:
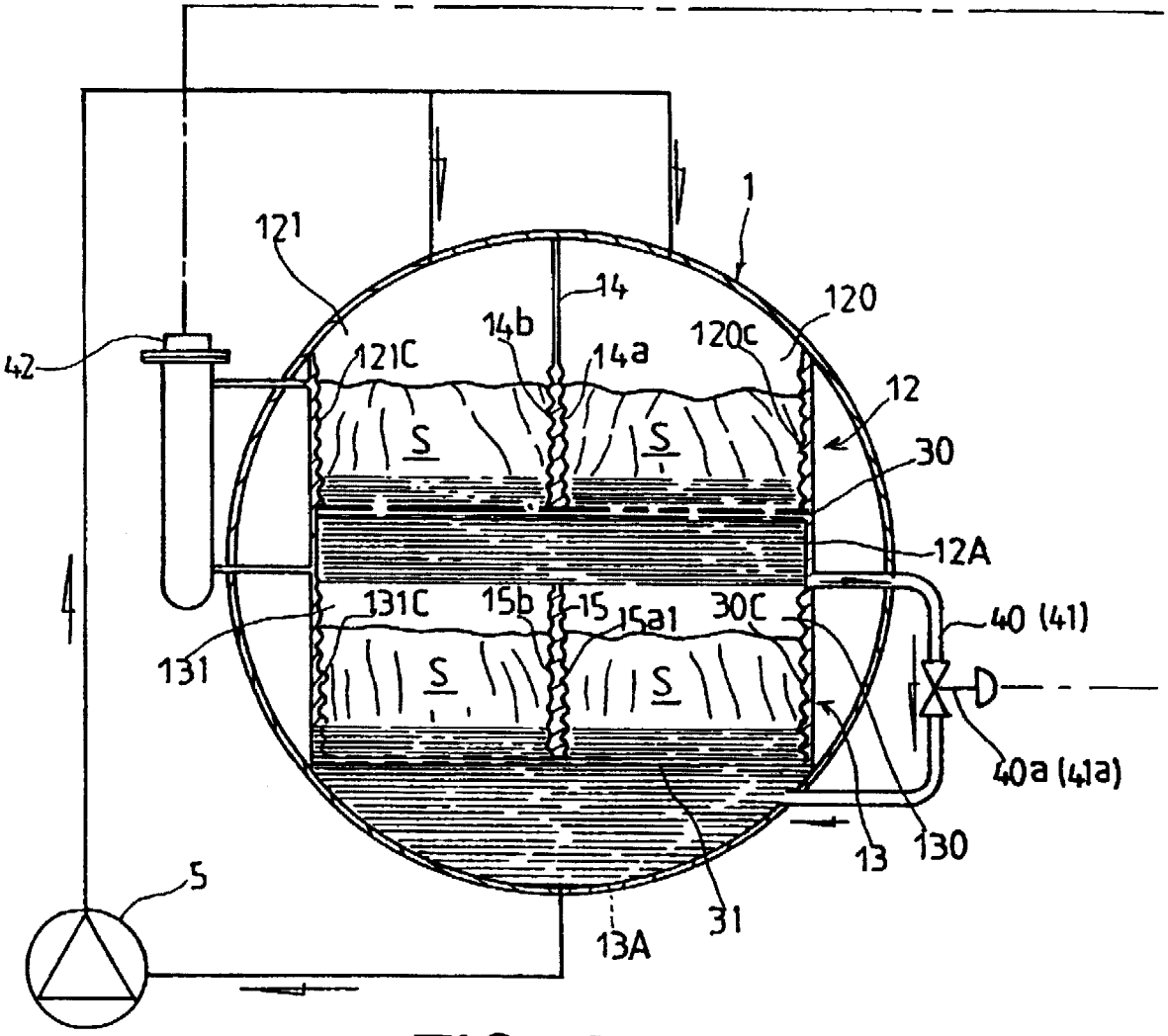
FIG. 5 shows a transversal cross-sectional view of the dyeing machine of FIG. 3 cutting through line A—A.

Referring to FIGS. 3, 4, and 5, the dyeing machine according to the present invention includes an elongated cylindrical casing 1 divided by a separator 11 into top fabric 12 holder and bottom fabric holder 13. As shown in FIG. 5, separators 14, 15 are used to divide the fabric holders 12, 13 into sub-holders 120, 121, 130, 131. Further, openings 120*a*, 130*a*, 120*b*, 130*b*, which are each provided with a cover, are provided on the rear and front ends of the sub-holders 120, 121, 130, 131. Spouters 2A, 2B are each provided on the separator 11 near the openings 130*a*, 130*b*. In the top fabric holder 12, a screen 30 is provided between the outlet of the spouters 2A, 2B and the entrance of the spouters 2C, 2D and the bottom of the fabric holder 12 is used as a dye container 12A. Similarly in the bottom fabric holder 13, a screen 31 is provided between the outlet of the spouters 2C, 2D and the entrance of the spouters 2A, 2B and the bottom of the fabric holder 13 is used as a dye container 13A.

The spouters 2A, 2B, 2C, 2D employed in the dyeing machine according to the present invention have two purposes: imparting the dye onto the fabric and driving the fabric to move forward. The structure of these spouters 2A, 2B, 2C, 2D is an important aspect of the present invention and which will be described later in detail with reference to FIG. 9 through FIG. 16.

Figure 6:
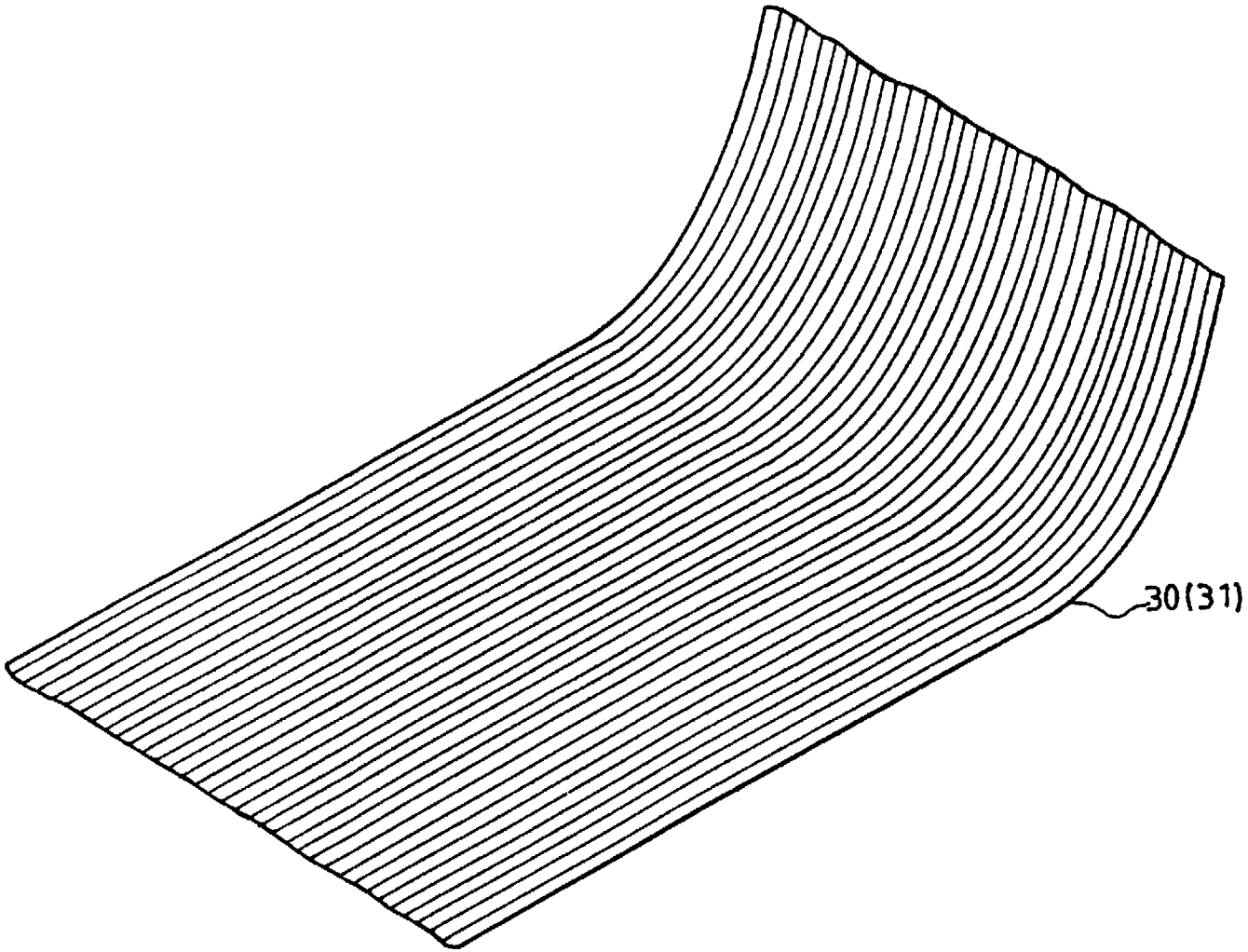
FIG. 6 shows a filtering screen employed in the dyeing machine according to the present invention.

The screen 30 in the top fabric holder 12 includes a reception portion 30*a*, a body portion 30*b*, and a guide portion 30*c*. The reception portion 30*a* is a sloped surface coupled to the outlet of the spouters 2A, 2B; the body portion 30*b* is a leveled surface that allows the movement of the fabric; and the guide portion 30*c* is used to direct the fabric upwards from the body portion 30*b* to the entrance of the spouters 2C, 2D. As shown in FIG. 6, the screen 30 is composed of parallel bars arranged along the direction of movement of the fabric, thus constituting parallel slits between the parallel bars. This type of arrangement allows excessive dye to drip quickly through the parallel slits on the screen 30 so as to be quickly separated from the fabric.

Similarly, the screen 31 includes a reception portion 31*a*, a body portion 31*b*, and a guide portion 31*c*. The reception portion 31*a* is a sloped surface coupled to the outlet of the spouters 2C, 2D; the body portion 31*b* is a leveled surface that allows the movement of the fabric; and the guide portion 31*c* is used to direct the fabric upwards from the body portion 31*b* to the entrance of the spouters 2A, 2B. As shown in FIG. 6, the screen 31 is collapsed of parallel bars arranged along the direction of movement of the fabric. This type of arrangement allows excessive dye to be separated from the fabric through the screen 31.

In order to stabilize the movement of the fabric S in the fabric holders 120, 130, 121, 131 so as to prevent the fabric S from being messed up, the separators 14, 15 are each corrugated longitudinally on the outer face 14*a*, 14*b*, 15*a*, 15*b* and the inner face 120C, 121C, 130C, 131C.

Further, two liquid level equalizing tubes 40, 41 are provided between the top fabric holder 12 and the bottom fabric holder 13 near the dye containers 12A and 13A. As shown in FIG. 4, the liquid level equalizing tube 40 connects the dye containers 12A, 13A and provided with a valve 40*a*. A liquid level detector 42, which is a conventional device is used to detect the level of the dye contained in the top fabric holder 12. When the level exceeds a preset upper limit, the liquid level detector 42 commands the valves 40*a*, 41*a* to open so its to allow the dye in the top fabric holder 12 to flow to the bottom a fabric holder 13. The valves 40*a*, 41*a* are closed again when the liquid level detector 42 detects that the level of the dye in the top fabric holder 12 is below a preset bottom limit.

A pump 5 is used to suck the dye in the dye container 13A in the bottom fabric holder 13 through pipes 50, 51 to the heat exchanger 6. The volume of the dye being sucked out is controlled by the valves 50*a*, 51*a*. The heated dye is then directed in two ways respectively through the pipe 60 to the spouters 2A, 2B and through the pipe 61 to the spouters 2C, 2D. After being sprayed onto the fabric, excessive dye that is not absorbed by the fabric passes through the screens 30 31 back to the dye containers 12A, 13A.

In the following description of the top fabric holder 12 and the bottom fabric holder 13, since the two containers are identical in structure, the description will be directed only to the top fabric holder 12.

In the top fabric holder 12, the contorted dye is filled up to a level higher than where the body portion 30*b* (31*b*) of the screen 30 (31) is located. At first in the operation, the operator opens the door 130*a* so as to feed the fabric S through the entrance of the spouters 2A to the passage 22 and then turns on the pump 5 so as to suck dye from the dye container 13A to the heat exchanger 6. The heated dye is then directed to chambers 23*a*5, 23*b*5 where the dye is ready for discharging through the spouter 2A. By way of forceful discharging, the discharged dye not only adds colors to the fabric, but also exerts a pushing force on the fabric so as to move the fabric toward the outlet of the spouter 2A. After leaving the outlet of the spouter 2A, the fabric along with the excessive dye not absorbed by the fabric are received by the reception portion 30*a* of the screen 30. The excessive dye then drips through the screen 30 to the dye container 12A and the fabric is directed to the body portion 30*b* of the screen 30 where the liquid level of the dye is above the screen 30 and the fabric is self folded by means of its own movement. At the departure portion 30*c* of the screen 30, the fabric S is again set apart from the dye and the excessive dye on the fabric drips to the dye container 12A.

An opening 120*a* provided above the departure portion 30*c* allows the operator to manually guide the fabric S to the passage 22 in the spouter 2C where the fabric undergoes another cycle of dyeing process. At the outlet of the spouter 2C, the fabric along with the excessive dye thereon are received by the reception portion 31*a* of the screen 31. The excessive dye then drips through the screen 31 to the dye container 13A and the fabric is directed to the body portion 31*b* of the screen 31 where the fluid level of the dye is above the screen 31 and the fabric is self folded by means of its own movement. After leaving the screen 31, an opening 130*a* allows the operator to manually connect the head portion of the fabric S to the tail portion that is ready to enter the spouter 2A. After that, the openings 120*a*, 120*b*, 130*a*, 130*b* are closed and the process is repeated until the dyeing of the fabric is completed.

During the dyeing process, the liquid level detector 42 detects the liquid level of the dye in the top fabric holder 12. If the level is above a preset upper limit, the valves 40*a*, 41*a* that controls the liquid level equalizing tube 40 are opened so as to allow the dye in the top dye container 12A to flow to the bottom dye container 13A. When the liquid level detector 42 detects that the liquid level or the dye in the top dye container 12A is below a preset bottom limit, the valves 40*a*, 41*a* are dosed again. This allows the liquid level of the dye in the top fabric holder 12 and that in the bottom fabric holder 15 to be maintained in appropriate operating range so as to provide sufficient quantity for the dye to float the fabric for movement on the body portions 30*b* (31B) or the screen 30 (31).

Furthermore, the valves 50*a*, 51*a* are used to control the pump 5 for the volume of dye being sucked so as to maintain a balance of the dye in the front and rear sections of the bottom fabric holder 13. For example, if the valve 50*a* is wide open, it sucks more volume or dye from the front section than from the rear section. Also, the heated dye from the heat exchanger 6 is controlled by the valves 60*a*, 60*b*, 61*a*, 61*b* for the quantity being supplied to the spouters 2A, 2B, 2C, 2D.

Figure 7:
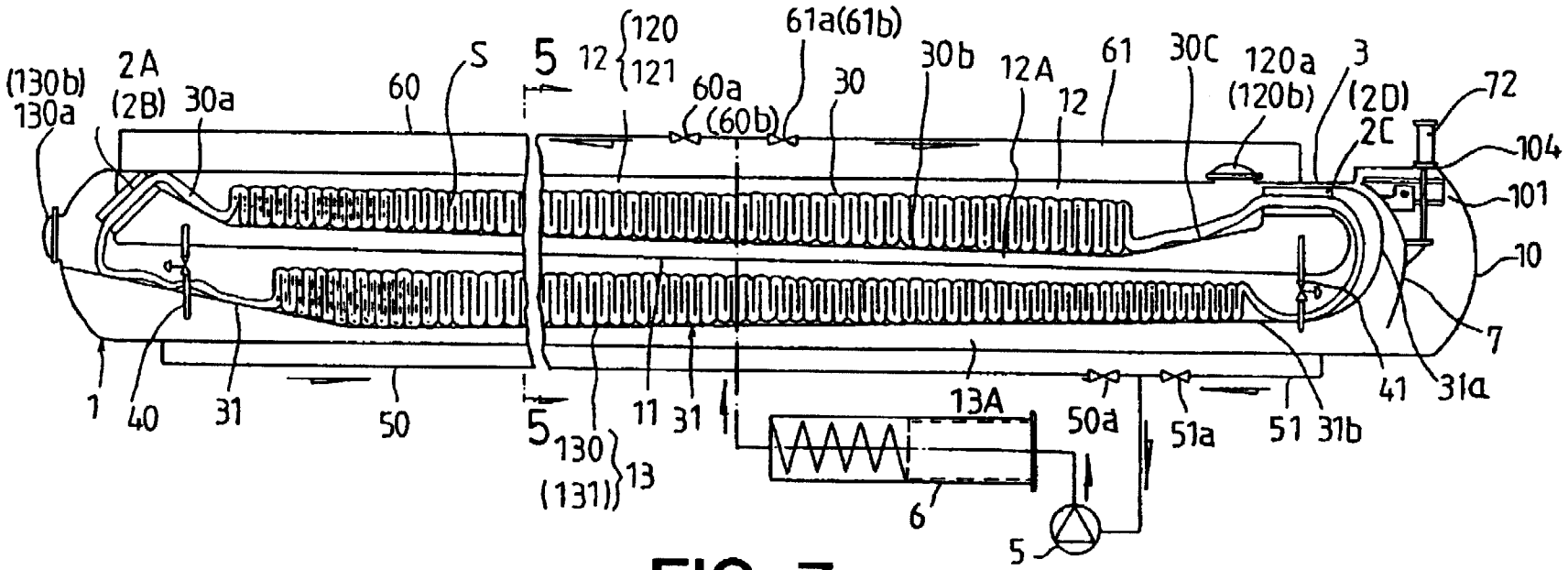
FIG. 7 shows another side cross-sectional view of the dyeing machine according to the present invention, particularly used to depict a dye/fabric separating adjuster employed in the dyeing machine.
Figure 8A:
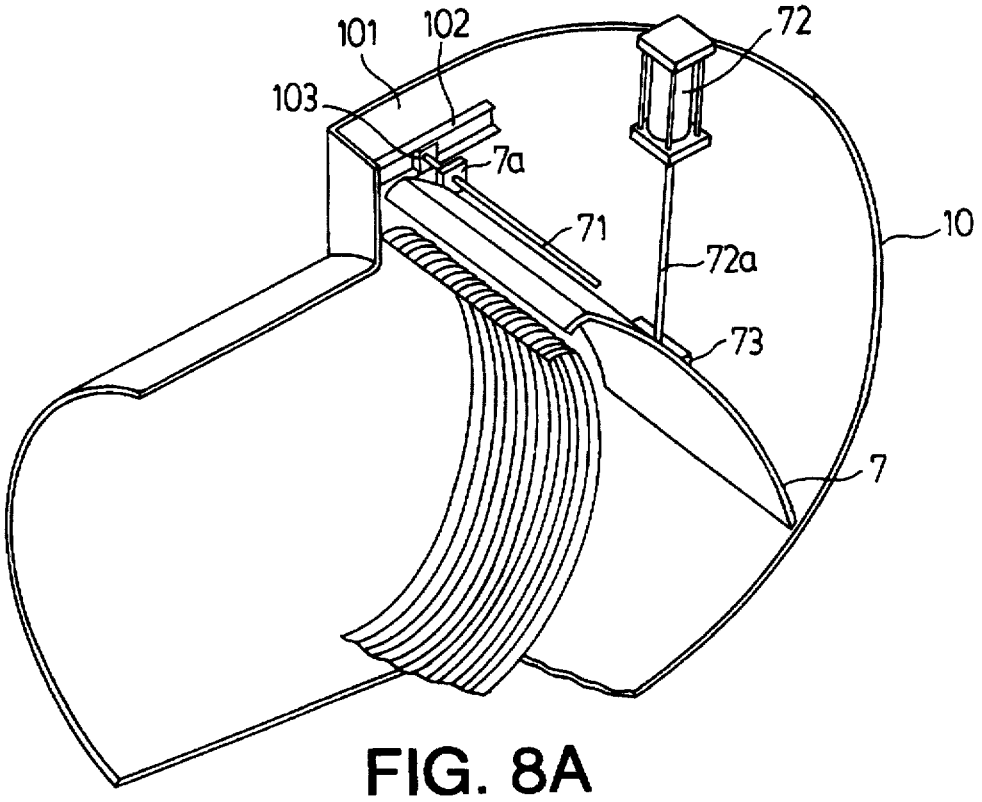
FIGS. 8A–8B are enlarged views of the dye/fabric separating adjuster.
Figure 8B:
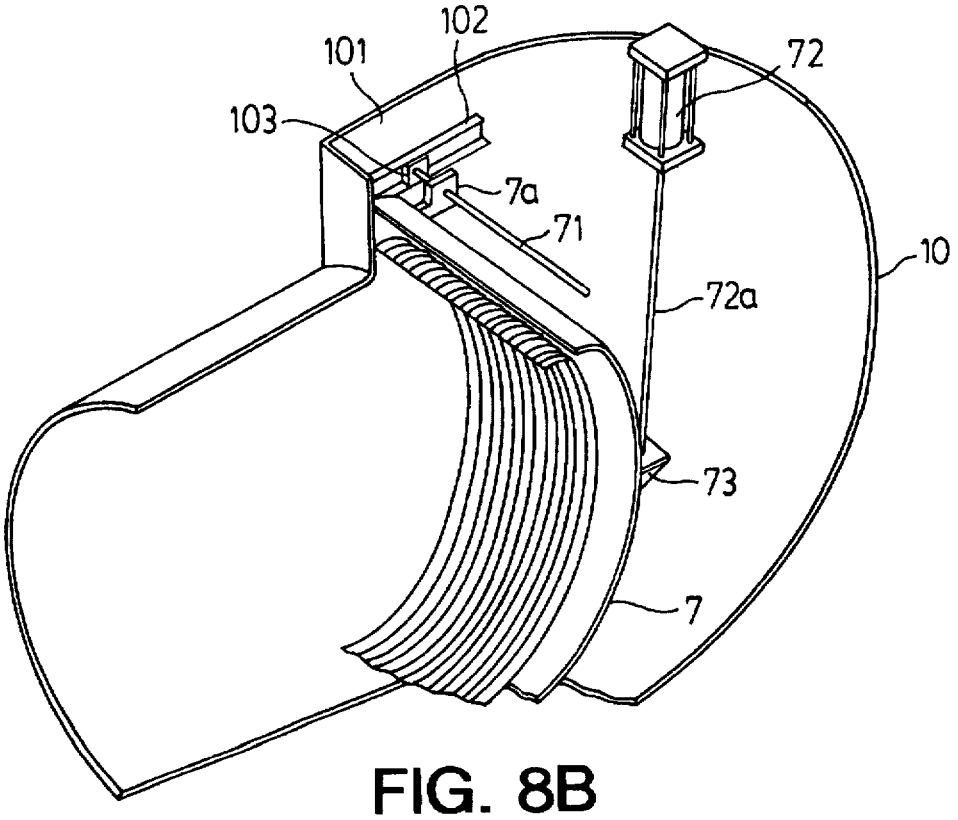

FIG. 7 shows the use of another preferred embodiment or the present invention in which a dye/fabric separating adjuster 7 is used and FIGS. 8A–8B are enlarged views of the dye/fabric separating adjuster 7. The dye/fabric separating adjuster 7 is a curved member coupled to the outside or the reception portion 31*a* or the screen 31. The casing 1 has an extended portion 10 and guide grooves 102 (only one is shown) are provided oppositely on the inner wall of the extended portion 10. Each guide groove 102 mounts a slidable member 103. Further, the dye/fabric separating adjuster 7 is provided with two supporting pieces 70 (only one is shown). A beam 71 is provided on the supporting piece 70 with its two ends connected to the slidable members 103.

Furthermore, a pressure pump 72 is provided near the top of the extended portion 10 and has its shalt 72*a* coupled to a protruded piece 73 on the back or the dye/fabric separating adjuster 7.

As shown in FIG. 8A, in order to let the discharged dye front the spouters 2C, 2D be more easily separable from the fabric, the pressure pump 72 is driven to withdraw the shaft 72*a* so as to pull the dye/fabric separating adjuster 7 upwards from its back. This causes the top of the dye/fabric separating adjuster 7 to be shifted toward the reception portion 31*a* of the screen 31 by way of the supporting pieces 70, beam 71, and slidable members 103 on the guide groove 102. When the dye/fabric separating adjuster 7 is in lifted condition, the dye can drip through the reception portion 31*a* of the screen 31 so as to be separated from the fabric.

On the other hand, as shown in FIG. 8B, if the pressure pump 72 extends out the shaft 72*a*, the dye/fabric separating adjuster 7 is pushed downwards toward the reception portion 31*a* of the screen 31 by way of by way of the supporting pieces 70, beam 71, and slidable members 103 on the guide groove 102. When the dye/fabric separating adjuster 7 is abutted to the reception portion 31*a* of the screen 31, it acts as a barrier that reduces the quantity of the dye dripping through the reception portion 31*a* of the screen 31 to the dye container.

With the foregoing provision, the separation rate of the dye from the fabric can be adjusted in accordance with the actual operating condition so as to allow the fabric on the body portion 31*b* of the screen 31 to be smoothly self folded and also allow the dye to have sufficient level to float the fabric. This can prevent the fabric from being turned over and messed up in the dyeing machine.

Compared to prior an dyeing machines, the dyeing machine according to the present invention has several advantages. First, since the casing of the dyeing machine according to the present invention, which is substantially equal in volume as the prior art ones, is divided into top and bottom fabric holders, it can process twice as much the quantity of fabric without taking up twice as much room in the factory. Second, the top and bottom fabric holders are further subdivided into several sub-containers, allowing the dyeing machine according to the present invention to process much larger quantity of fabric than the prior art ones. Third, the fabric holders and sub-containers can use a common dye recycling and heating system such that costs in equipment, energy consumption, waste disposal are significantly reduced. Fourth, since a common dye recycling system is used, the color dyed to the fabric is consistent such that the color quality of the dyed fabric is high. Fifth, since the top fabric holder and the bottom fabric holder are each provided with a spouter, the time required for the dyeing process is, comparing to the prior art, half reduced. Sixth, since the side faces of the sub-containers are corrugated, the movement of the fabric can be more stabilized such that the fabric can be self folded neatly. Seventh, since the screen used to separate the dye from the fabric is composed of parallel bars, and thereby parallel slits between the parallel bars, excessive dye on the fabric can be separated from the fabric by dripping through the screen more quickly. In this way, the fabric can be more likely to be neatly self folded. Eighth, since the front end and the rear end of the dyeing machine according to the present invention are each provided with a spouter, there is no need for the dyeing machine according to the present invention to install a motor roller as in the prior art, thus eliminating all the drawbacks caused by the provision of the motor roller in the prior art. Ninth, with the provision of the liquid level equalizing tube, the top and bottom fabric holders can be maintained at appropriate liquid level for the dye therein so as to provide sufficient quantity of dye to float the fabric passing therethrough. Tenth, since the outside of the reception portion 31*a* of the screen 31 is provided with a dye/fabric separating adjuster, the separation rate of excessive dye from the fabric can be adjusted accordance with the actual operating condition such that the movement of the fabric through the subsequent screen can be smooth and stable, allowing the fabric to be neatly self folded.

Figure 9:
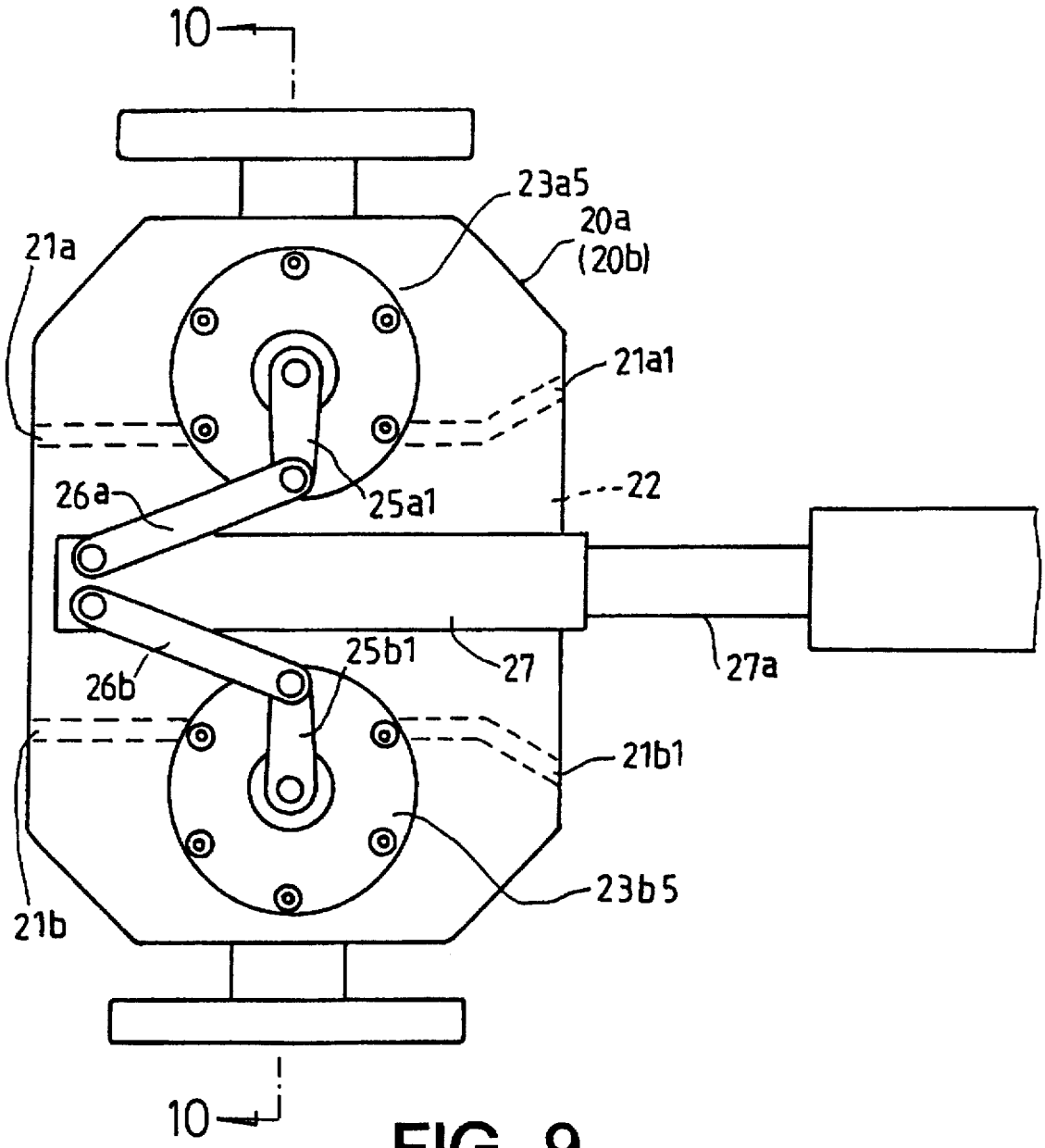
FIG. 9 shows a front view of a dye spouter employed in the dyeing machine according to the present invention.
Figure 10:
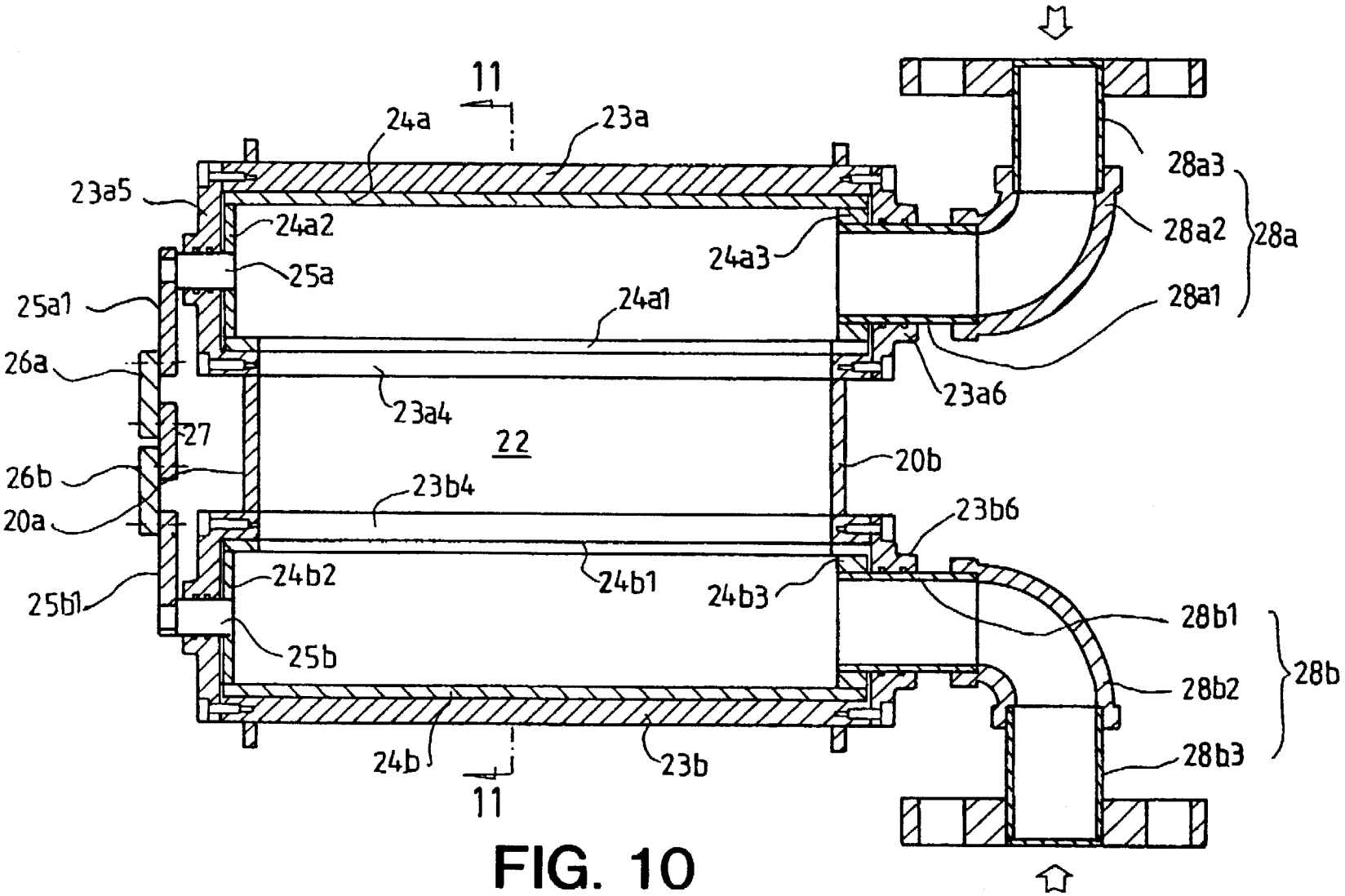
FIG. 10 is a cross-sectional view of the dye spouter of FIG. 9 cutting through line B—B.
Figure 11:
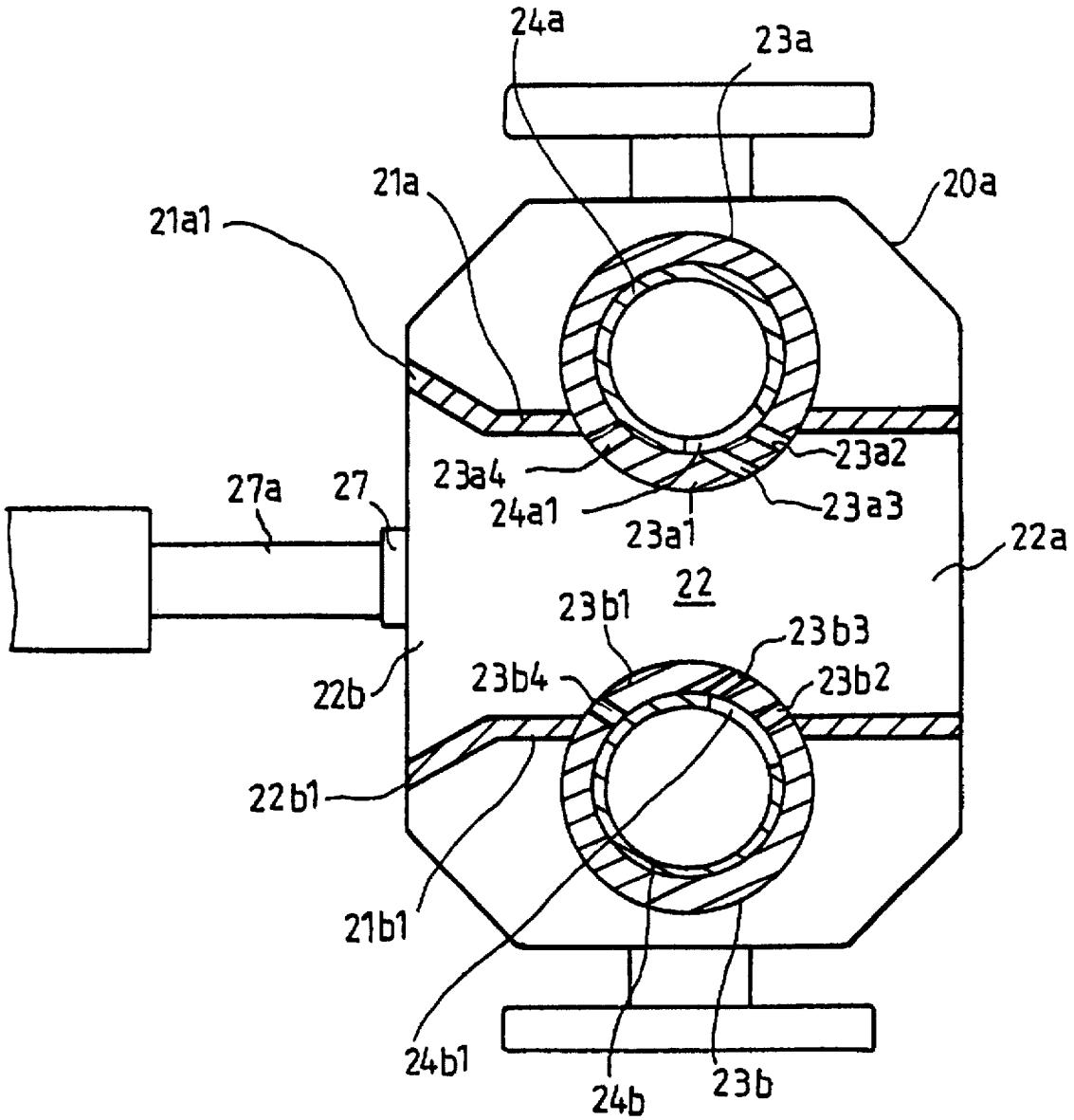
FIG. 11 is another cross-sectional view of the dye spouter of FIG. 9 cutting through line C—C.

In the aforementioned dyeing machine according to the present invention, it is an important aspect of the present invention that each of the spouters 2A, 2B, 2C, 2D is of a reversible type that can discharge the dye in two directions: one to move the fabric forwards and one to move the fabric backwards. Referring to FIGS. 9, 10, and 11, each of the spouters 2A, 2B, 2C, 2D includes a top board 21*a* and a bottom board 21*b* provided between the side walls 20*a* and 20*b* so as to form a passage 22 for the fabric. The exit 21*a*1 of the top board 21*a* and the exit 21*b*1 of the bottom board 21*b* are each bent outwards so as to form a wide exit opening 22*a* for the passage 22 to allow the fabric more easily to be thrown out of the spouter.

A top cylindrical chamber 23*a* and a bottom cylindrical chamber 23*b* are respectively provided above the top board 21*a* and beneath the bottom board 21*b*. The top cylindrical chamber 23*a* has one end 23*a*1 penetrating through the top board 21*a* to the passage 22 and formed with forward nozzles 23*a*2, 23*a*3 near the exit 22*a* and reverse nozzles 23*a*4 near the entrance 22*b*. Similarly, the bottom cylindrical chamber 23*b* has one end 23*b*1 penetrating through the bottom board 21*b* to the passage 22 and formed with forward nozzles 23*b*2, 23*b*3 near the exit 22*a* and reverse nozzles 23*b*4 near the entrance 22*b*. The forward nozzles 23*a*2, 23*a*3, 23*b*2, 23*b*3 and the reverse nozzles 23*a*4, 23*b*4 have lengthwise slit-like openings for the discharging of the dye.

The cylindrical chambers 23*a*, 23*b* are mounted with rotatory nozzle selectors 24*a*, 23*b* having lengthwise openings 24*a*1, 24*b*1 with a length about equal to that of the nozzles and a width about equal to that of two forward nozzles 23*a*2, 23*a*3 (or 23*b*2, 23*b*3) such that it can be coupled to the two forward nozzles 23*a*2, 23*a*3 (or 23*b*2, 23*b*3).

The cylindrical chambers 23*a*, 23*b* and the nozzle selectors 24*a*, 24*b* have their front ends penetrating through the left board 20*a* and the fight board 20*b*. On the left, a firs left sealing board 23*a*5 is secured by screws to the top cylindrical chamber 23*a* and a second left sealing board 23*a*2 is provided on the nozzle selector 24*a*. A shaft 25*a* penetrates through the first left sealing board 23*a*5 on the top cylindrical chamber 23*a* and has its inner end affixed to the 24*a*2 on the nozzle selector 24*a* and its outer end penetrates through the first left sealing board 23*a*5 to be coupled to a swinging bar 25*a*1. When the swinging 25*a*1 is driven to move, the shaft 25*a* is driven to rotate, thereby driving the nozzle selector 24*a* to rotate such that its opening 24*a*1 is selectively coupled to either the reverse nozzle or forward nozzle.

Similarly, a first left sealing board 23*b*5 is secured by screws to the bottom cylindrical chamber 23*b* and a second left sealing board 23*b*2 is provided on the nozzle selector 24*b*. A shaft 25*b* penetrates through the first left sealing board 23*b*5 on the bottom cylindrical chamber 23*b* and has its inner end affixed to the 24*b*2 on the nozzle selector 24*b* and its outer end penetrates through the first left sealing board 23*b*5 to be coupled to a swinging bar 25*b*1. When the swinging 25*b*1 is driven to move, the shaft 25*b* is driven to rotate, thereby driving the nozzle selector 24*b* to rotate such that its opening 24*b*1 is selectively coupled to either the reverse nozzle or forward nozzle.

The swinging bar 25*a*1 has one end affixed to a linkage bar 26*a* and similarly the swinging bar 25*b*1 has one end affixed to a linkage bar 26*b*. Both of the linkage bars 26*a*, 26*b* have the front ends pivotally coupled to a common driving bar 27 and the rear ends coupled via a linkage bar 27*a* to a driving mechanism (not shown) used to drive the driving bar for reciprocal motion which in turn drives the nozzle selectors 24*a*, 24*b* via the linkage bar 26*a* (26*b*) and swinging bar 25*a*1 (25*b*1).

The cylindrical chambers 2*a*, 23*b* have their right ends secured by screws with first right sealing boards 23*a*6, 23*b*6 and also the nozzle selectors 24*a*, 24*b* have their right ends secured by screws with second right sealing boards 24*a*3, 24*a*6. A dye duct 28*a* composed of connecting tube 28*a*1, angled tube 28*a*2, and flange 28*a*3 is provided on the first fight sealing boards 23*a*6 on the top cylindrical chamber 23*a* and on the second right sealing boards 24*a*3 on the nozzle selector 24*a* for directing dye into the inside of the top cylindrical chamber 23*a*. Similarly, a dye duct 28*b* composed of connecting tube 28*b*1, angled tube 28*b*2, and flange 28*b*3 is provided on the first right sealing boards 23*b*6 on the top cylindrical chamber 23*b* and on the second right sealing boards 24*b*3 on the nozzle selector 24*b* for directing dye into the inside or the top cylindrical chamber 23*b*.

Figures 12A, 12B, 12C, 12D:
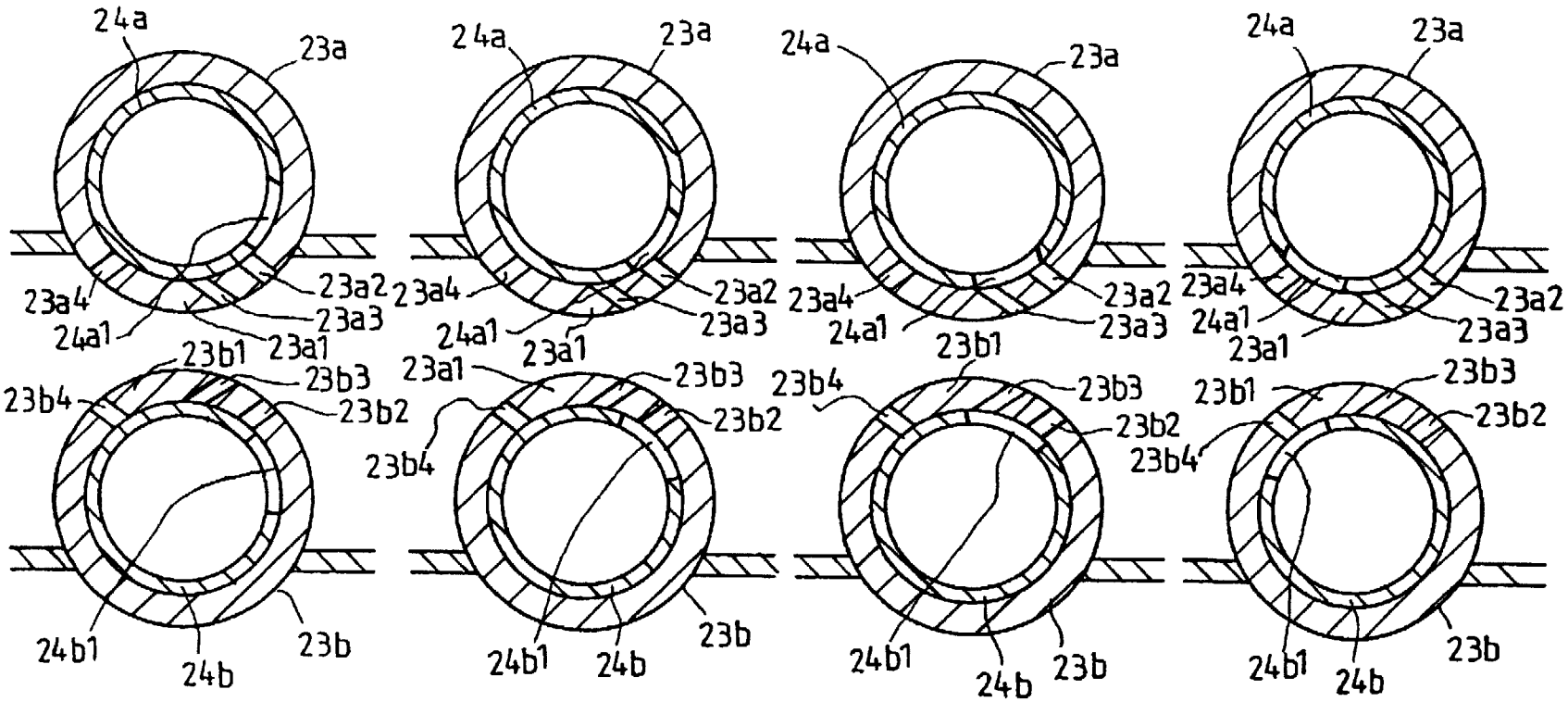
FIGS. 12A–12D each shows an open/closed condition of the dye spouter according to the present invention.

In the operation of the dyeing machine, the fabric to be dyed is fed through the entrance 22*b* into the passage 22 and the dye is fed through the ducts 28*a*, 28*b* into the inside of the cylindrical chambers 23*a*, 23*b* for for coloring the fabric. As shown in FIG. 12A, the opening 24*a*1 of the nozzle selector 24*a* and the opening 24*b*1 of the nozzle selector 24*b* are shifted to positions where they are not in fluid communication with the forward nozzles 23*a*2, 23*a*3 on the top cylindrical chamber 23*a* and the forward nozzles 23*b*2, 23*b*3 on the bottom cylindrical chamber 23*b*, whereby the forward nozzles 23*a*2, 23*a*3 and 23*b*2, 23*b*3 are closed.

To open the forward nozzles 23*a*2, 23*a*3 and 23*b*2, 23*b*3 so as to discharge the dye out onto the fabric the nozzle selectors 24*a*, 24*b* can be turned by a specific angle to a position as shown in FIG. 12B. This can be achieved by commanding the driving mechanism (not shown) to turn the nozzle selectors 24*a* (24*b*) by way of transmission through the driving bar 27 that drives the linkage bar 26*a* and swinging bar 25*a*1 (or linkage bar 26*b* and swinging bar 25*b*1). At that position, the opening 24*a*1 or the nozzle selector 24*a* is coupled to the forward nozzle 23*a*2 on the nozzle selector 23*a* and the opening 24*b*1 of the nozzle selector 24*b* is coupled to the forward nozzle 23*b*2 on the nozzle selector 23*b*, whereby the forward nozzles 23*a*2, 23*b*2 are opened so that they can discharge the dye out onto the fabric.

When the driving bar 27 further turns the nozzle selectors 24*a*, 24*b* by another angle to a position as illustrated in FIG. 12C where the opening 24*a*1 of the nozzle selector 24*a* is coupled at the same time to the forward nozzles 23*a*1 and 23a2 on the top cylindrical chamber 23a and the opening 24b1 of the nozzle selector 24b is coupled at the same time to the forward nozzles 23b1 and 23b2 on the bottom cylindrical chamber 23b. In this case, the dye can be discharged at the same from the two forward nozzles 23a1 and 23a2, and also from the two forward nozzles 23b1 and 23b2. This allows the amount of the dye being discharged to be increased so that the fabric can be more quickly dyed and also be moved more quickly.

During the dyeing process when the nozzle selectors 24a, 24b are set in position shown in FIG. 3C, if it is found that the self-folding of the fabric is disturbed such that it is not neatly folded, the nozzle selectors 24a, 24b can be turned by another angle to a position as illustrated in FIG. 3D where the opening 24a1 of the nozzle selector 24a is coupled to the reverse nozzle 23a3 in the top cylindrical chamber 23a and the opening 24a1 of the nozzle selector 24b is coupled to the reverse nozzle 23b3 in the top cylindrical chamber 23b, in this case, the dye is discharged through the reverse nozzles 23a3, 23b3 such that the fabric is forced to move backwards. The disorderly folded fabric can thus be unfolded so that when the fabric is forced to move forward later again, the fabric can try to self fold itself neatly for another round.

In another preferred embodiment, the opening of the nozzle selector can be ¼, ⅓, ½, ⅔, or ¾ coupled to the reverse nozzle. In this way, the amount of the dye being discharged can be line adjusted so as to make the dyeing process more adaptive.

In summary, the spouter employed by the dyeing machine according to the present invention is provided with forward and reverse discharging capability. In normal operating conditions, the spouter is selected to be operated in forward mode so as to move the fabric forward from the entrance to the exit of the dyeing machine; and in abnormal operating condition when the self-folding of the fabric is disturbed such that the fabric is disorderly self-folded, the spouter can be switched to reverse mode so as to move the fabric backward and thus unfolding the disorderly folded fabric. After the fabric is unfolded, the spouter can be switched back to forward mode again so as to move the fabric forward again to try for another round to self fold itself neatly.

Figure 13:
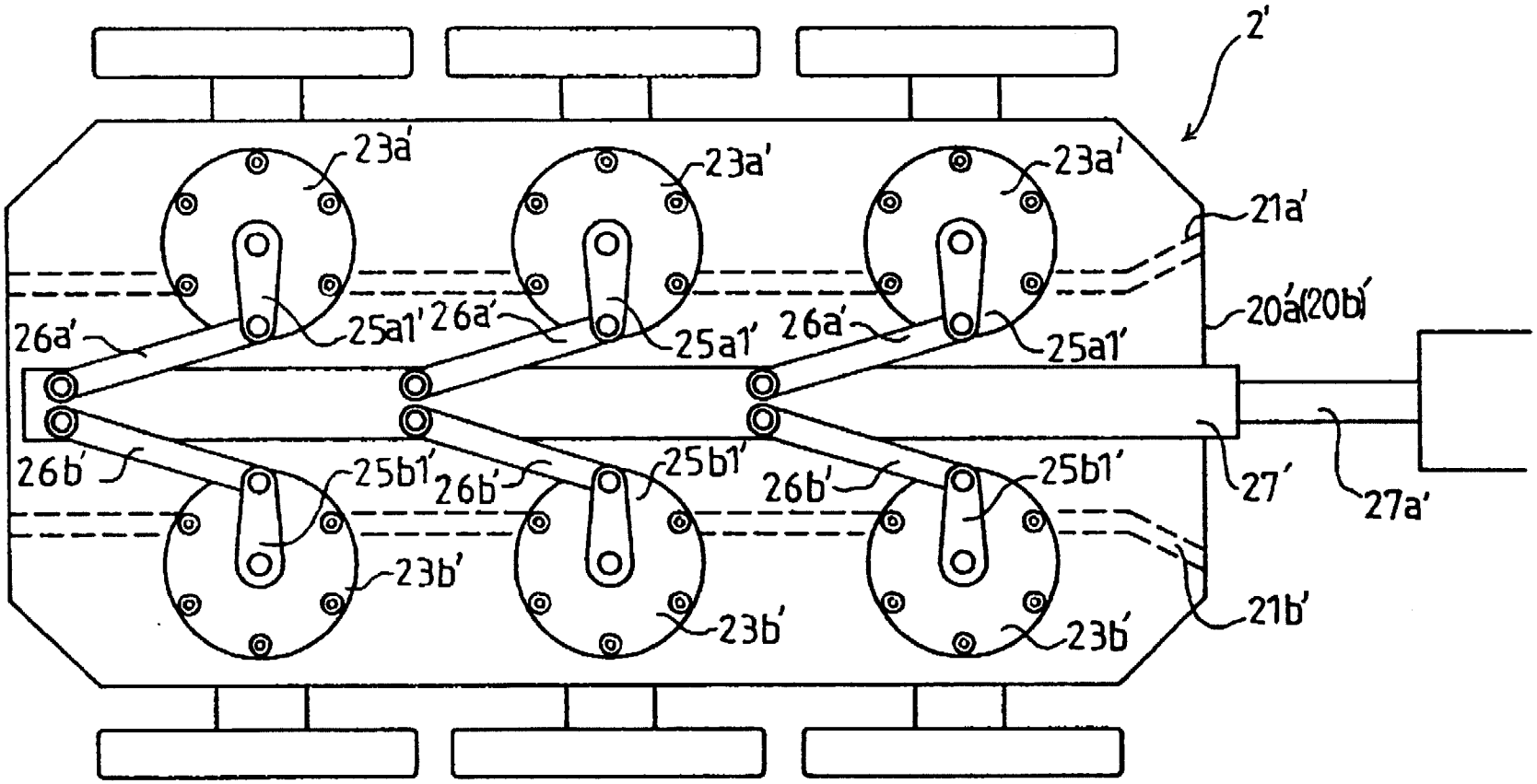
FIG. 13 shows a front view of the dye spouter according to the present invention.

In practical applications, a series of multiple spouters can be provided in the dyeing machine as shown in FIG. 13 such that the fabric can undergo repeated dyeing stages through the dyeing machine. This allows the dyeing process to be more efficiently completed. And also, the backward pulling of the fabric is more effortless for the dyeing machine.

Figure 14:
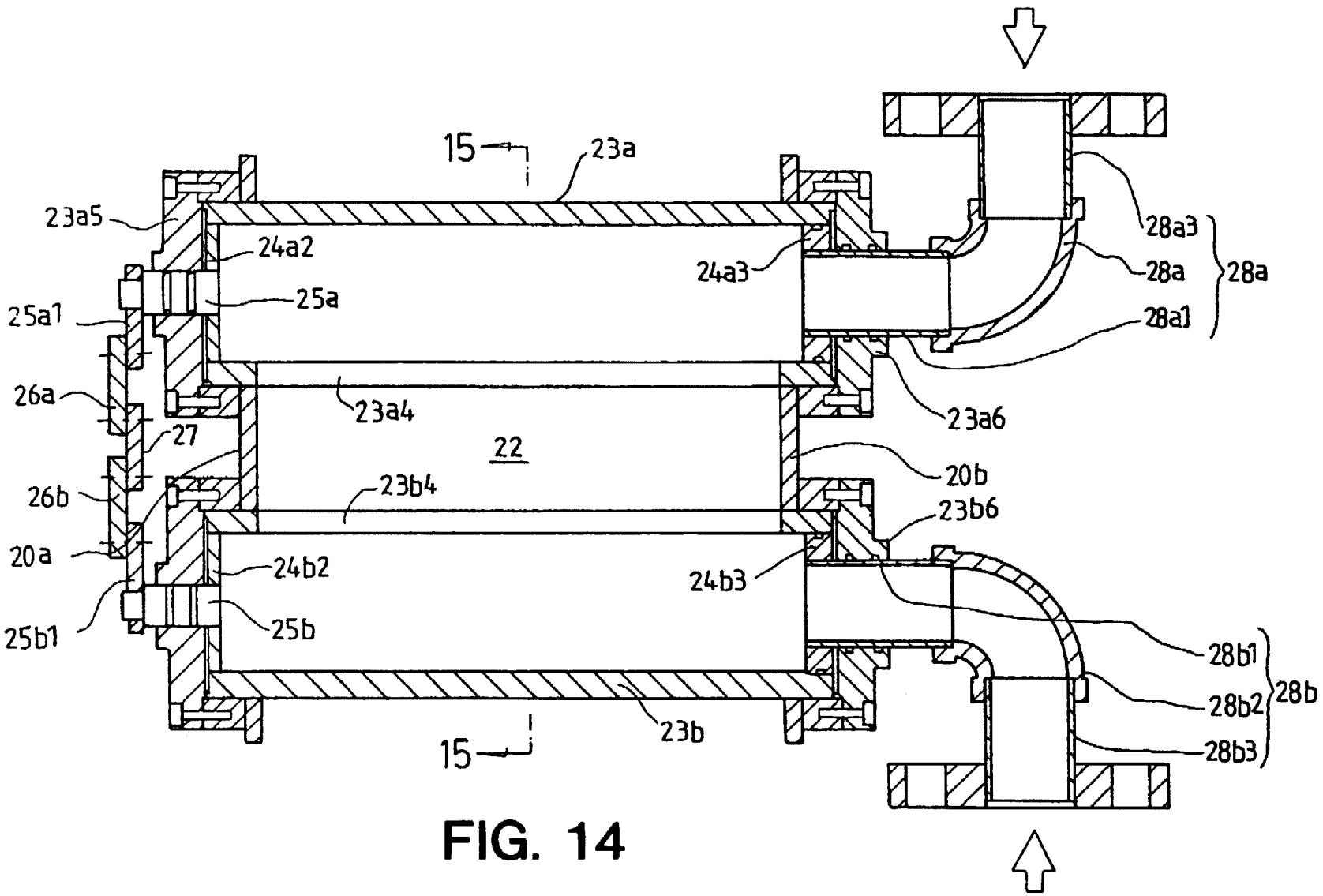
FIG. 14 shows a longitudinal sectional-view of a second preferred embodiment of the dye spouter according to the present invention.
Figure 15:
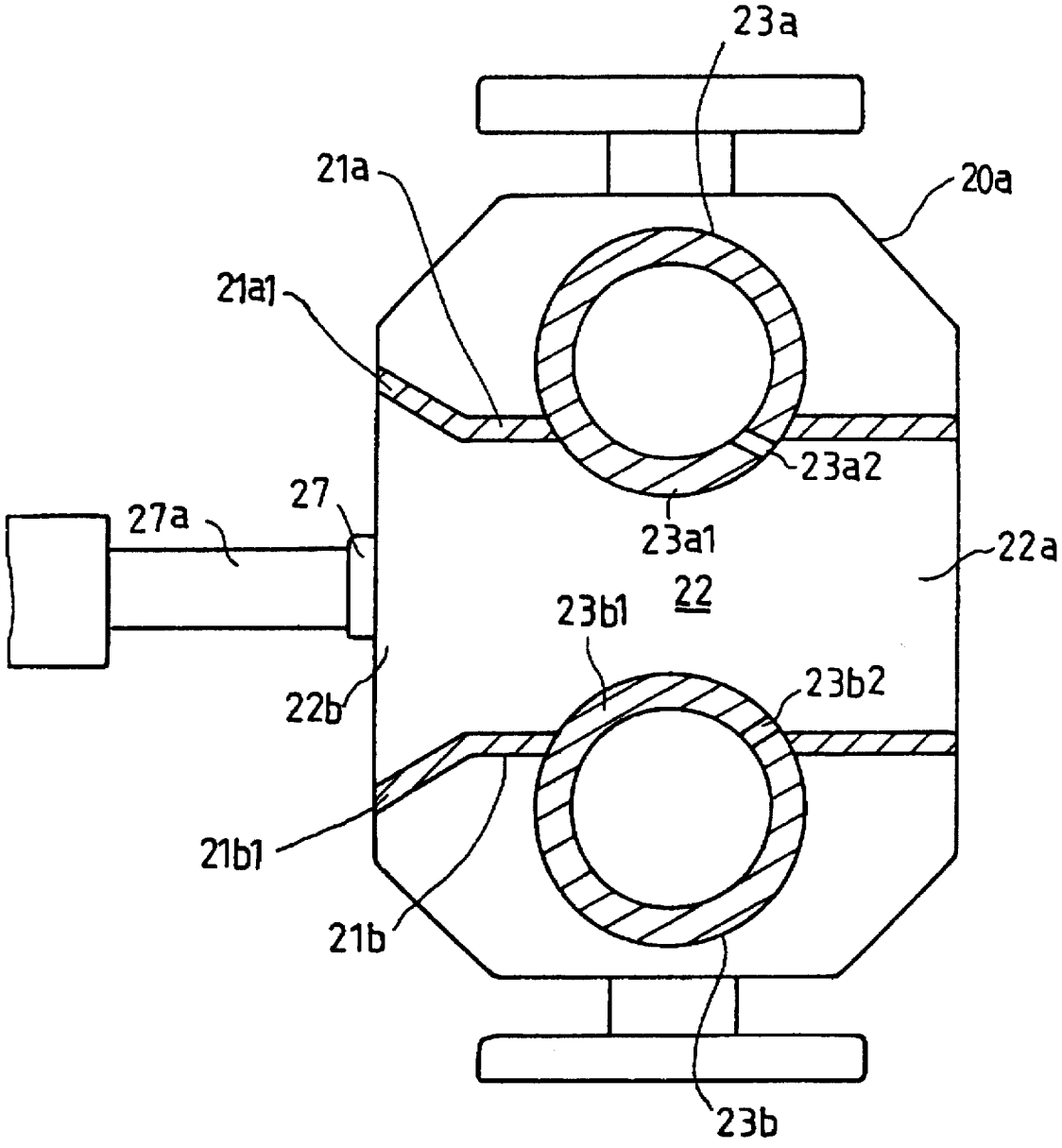
FIG. 15 is a cross-sectional view of the dye spouter of FIG. 14 cutting through line D—D.
Figure 16B:
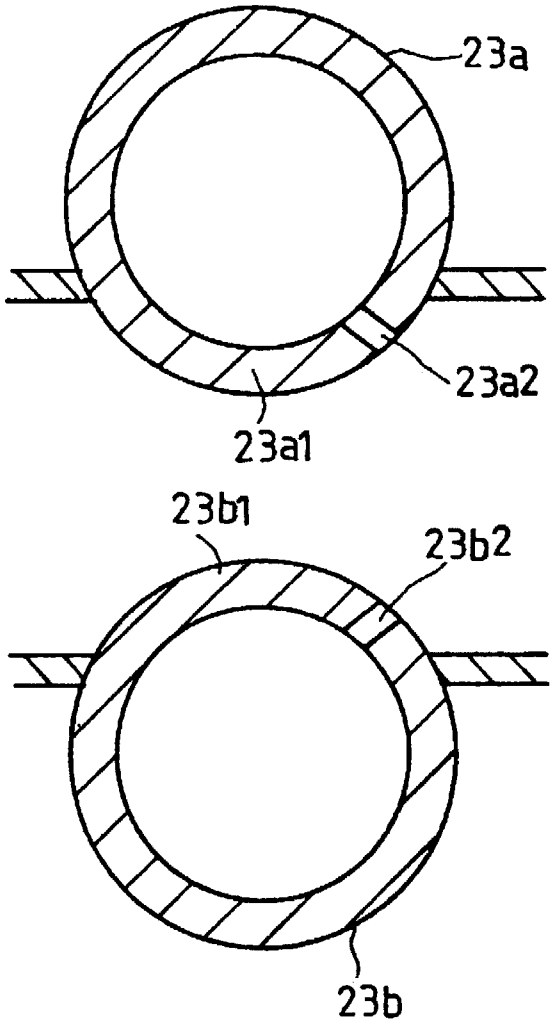
FIGS. 16A–16B are schematic diagrams used to depict the operation of the second preferred embodiment of the dye spouter according to the present invention.
Figure 16A:
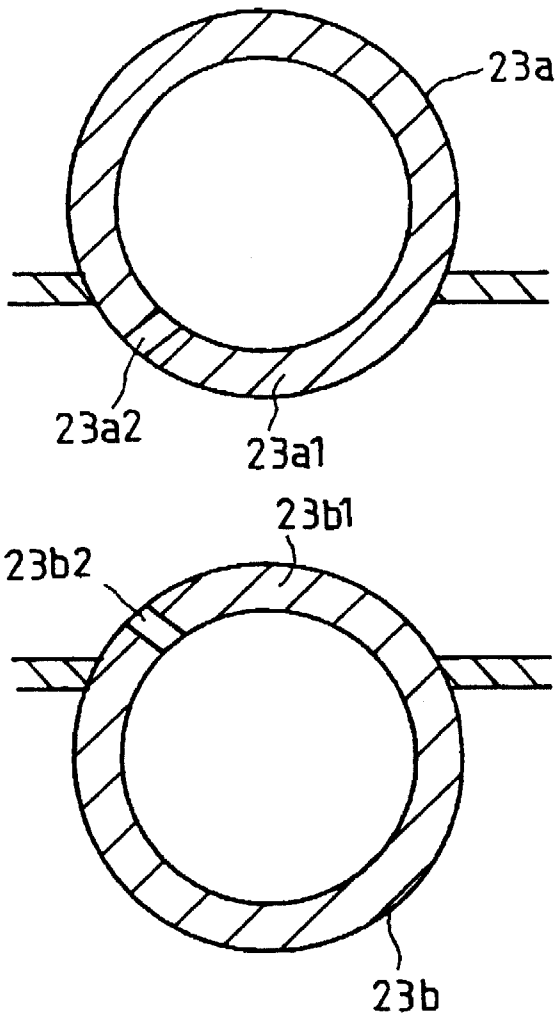

Still another preferred embodiment of the spouter is shown in FIGS. 14–16, which is a simplified version of the previous embodiment and in the drawings the same constituent elements as the previous embodiment are labeled with the same numerals. In this embodiment, the provision of the nozzle selectors 24a, 14b is eliminated, the cylindrical chambers 23a, 23b are made turnable with respect to the fabric passage 22, and the cylindrical chambers 23a, 23b are only mounted with the nozzles 23a2, 23b2 on top and bottom sides 23a1, 23b1 of the fabric passage 22. When the cylindrical chambers 23a, 23b are turned through transmission from the driving bar 27 via the linkage bars 26a, 26b and swinging bar 25a1, 25b1, the nozzles 23a2 can be switched between forward mode (FIG. 16A) and reverse mode (FIG. 16B). In forward mode, the fabric is forced to move forwards; and in reverse mode, the fabric is forced to move backward so as to unfold the disorderly folded fabric. After the fabric is unfolded, the nozzle can be switched back to forward mode again so as to move the fabric forward again.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A dye spouter for use on a dyeing machine to spout dye on fabric passing through a processing passage, comprising:

a dye supplying mechanism provided on the dyeing machine;

a dye container for containing dye supplied by said dye supplying mechanism;

a forward nozzle for discharging dye supplied by said dye supplying mechanism in forward direction to dye the fabric and also force the fabric to move forwards;

a reverse nozzle for discharging dye supplied by said dye supplying mechanism in reverse direction to dye the fabric and also force the fabric to move backwards;

a nozzle selector, rotatably provided in said dye container, for selectively allowing discharging of dye through said forward nozzle and said reverse nozzle; and a driving mechanism for driving said nozzle selector.

2. A dye spouter as claimed in claim 1, wherein said dye container is a circular container having a number of openings selectively switched by said nozzle selector for discharging dye.

3. A dye spouter as claimed in claim 1, wherein said dye container has a bottom wall facing the fabric processing passage and said forward nozzle and said reverse nozzle are provided on the bottom wall.

4. A dye spouter for use on a dyeing machine to spout dye on fabric passing through a processing passage, comprising:

a casing including a fabric entrance, a fabric processing passage, and a fabric exit;

a dye container for containing dye supplied by a dye supplying mechanism, said dye container having a bottom wall facing said fabric processing passage;

a plurality of nozzles, formed oil said bottom wall, for discharging dye onto the fabric;

a nozzle selector, rotatably provided in said dye container, for selecting one of said plurality of nozzles to discharge dye in said dye container; and a driving mechanism for driving said nozzle selector.

* * * * *